US006481622B2

(12) United States Patent
Hjelmvik

(10) Patent No.: US 6,481,622 B2
(45) **Date of Patent: *Nov. 19, 2002**

(54) DEVICE FOR MONITORING PARKED VEHICLES

(75) Inventor: Torbernt Hjelmvik, Järfälla (SE)

(73) Assignee: Modul-System Sweden AB, Järfälla (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,375

(22) PCT Filed: Jan. 8, 1998

(86) PCT No.: PCT/SE98/00008

§ 371 (c)(1),
(2), (4) Date: Jul. 8, 1999

(87) PCT Pub. No.: WO98/30982

PCT Pub. Date: Jul. 16, 1998

(65) Prior Publication Data

US 2002/0000465 A1 Jan. 3, 2002

(30) Foreign Application Priority Data

Jan. 10, 1997 (SE) ..... 9700054

(51) Int. Cl.[7] ..... G07B 7/02
(52) U.S. Cl. ..... 235/384; 235/385
(58) Field of Search ..... 235/384, 377, 235/382, 385, 462.24, 462.41; 705/52, 53, 56

(56) References Cited

U.S. PATENT DOCUMENTS

| | | | | |
|---|---|---|---|---|
| 4,310,890 A | | 1/1982 | Trehn et al. | 364/467 |
| 4,555,618 A | * | 11/1985 | Riskin | 235/384 |
| 4,908,500 A | | 3/1990 | Baumberger | 235/384 |
| 4,958,064 A | * | 9/1990 | Kirkpatrick | 235/384 |

FOREIGN PATENT DOCUMENTS

| | | |
|---|---|---|
| WO | WO9319435 | 9/1993 |
| WO | WO9320539 | 9/1993 |
| WO | WO9611453 | 4/1996 |
| WO | WO9627170 | 9/1996 |
| WO | WO9634366 | 10/1996 |

* cited by examiner

*Primary Examiner*—Michael G. Lee
*Assistant Examiner*—Daniel St. Cyr
(74) *Attorney, Agent, or Firm*—Alfred J. Mangels

(57) ABSTRACT

A parking control unit intended primarily for checking whether a parking fee has been paid in respect of a parked vehicle. The parking control unit is intended for use in a parking system of a kind in which the user registers an account number and the vehicle registration number at the commencement of a parking period, and again registers the account number at the end of the parking period. The account number, the registration number, the parking commencement time, and the parking termination time are stored in the memory of a central computer so that the parking time that has elapsed between the parking commencement time and the parking termination time can be billed to the account number that was registered at the commencement of the parking period.

9 Claims, 1 Drawing Sheet

DEVICE FOR MONITORING PARKED VEHICLES

BACKGROUND OF THE INVENTION

1. Field of the Invention

The present invention relates to a parking control unit for establishing whether or not a parking fee has been paid for parked vehicles.

2. Description of the Related Art

Cities will normally have one or more vehicle parking companies who distribute parking meters, or so-called pay meters, throughout the city in a number of different places, of which streets and large ground-based parking areas are the most common.

In addition to coin payments, it has become increasingly common practice to pay a parking fee with a cash card of one kind or another. Card payments are made by drawing the cash card through a card reader on the pay meter.

The invention relates to the type of payment system with which the person parking a vehicle draws the cash card through a card reader In the pay meter and the pay meter stores the cash-card number and the time at which the card was read.

It is highly desirable to be able to use any parking meter whatsoever when parking a vehicle and then use any parking meter or pay meter whatsoever to pay the parking fee when collecting the vehicle. Thus, it should be possible to commence a series of parking occasions at one place in the city or town and draw the cash card through the reader of a given meter, and to terminate the series of parking occasions at another place in the city or town, by drawing the cash card through the reader of another meter.

One problem with the majority of known systems is that the pay meter must produce a parking ticket that contains machine-readable information and that each pay meter must have a reader that is able to read the ticket. This requires the pay meters to be serviced at relatively short intervals, in order to ensure the function of the meters. It is also necessary to replenish the pay meters with tickets.

Handling of the tickets can also be problematic. A lost ticket must be reported as being lost, in order to be able to terminate parking of the vehicle concerned.

A solution to this problem is described in Swedish Patent Specification No. 960112-7.

The invention according to this prior patent relates to a method of cash card billing by means of parking meters or pay meters when parking a vehicle, wherewith a system of pay meters includes several pay meters that are equipped with a cash card reader. A person parking a vehicle will in initially look for a first pay meter and with the aid of the cash card reader enter information carried on the card, at least with respect to the card account number, wherewith the pay meter is caused to store the account number and the time at which parking had commenced in a memory belonging to the pay meter, when reading the cash card. In conjunction with terminating parking of the vehicle, the cash card is inserted into another pay meter and read by the card reader of this meter, this latter pay meter optionally being any chosen pay meter in the pay meter system, including the pay meter first mentioned. The second pay meter is caused to store the account number together with the time at which the card was read, i.e. the parking terminating time, in a memory belonging to this second pay meter.

The invention according to this prior patent is characterized in that each pay meter has a keyboard by means of which a person can enter the registration number of the vehicle to be parked, in conjunction with causing the cash card to be read by the card meter at the commencement of parking of the vehicle. The pay meter is caused to store the vehicle registration number together with the account number and the time at which parking commenced, and the memory of each pay meter is connected to the memory of a central computer; and in that billing is carried out on the account number carried on the cash card in question for the parking time that has elapsed between commencing and terminating the parking of the vehicle.

According to one embodiment of this patent, the system of pay meters can be instructed to print-out or display those vehicle registration numbers that have commenced a parking period but have not terminated a parking period of the vehicle.

This instruction may, for instance, be given in a manner such that a car park attendant inserts a special authorization card in the card reader. The pay meter will be designed to print-out a list of vehicle registration numbers in numerical order with regard to those vehicles where a parking has not been terminated. Alternatively, the registration numbers can be shown on a display in alphabetical numerical order and the car park attendant can skim between registration numbers with the aid of arrow keys, for instance.

The car park superintendent can then compare the registration numbers of parked vehicles with numbers displayed or printed-out by the system. A vehicle whose registration number is not found In the system will be duly fined.

It will be understood that the system described in this prior patent specification is best suited for parking systems whose geographical separation is limited, such as multi-car parks or ground-based car parks. When the system is applied, for instance, over the whole city center, the lists will be very comprehensive and quickly out of date.

The present invention solves this problem and provides a very fast and effective parking control unit.

SUMMARY OF THE INVENTION

The present invention thus relates to a parking control unit which is intended primarily for checking whether or not a parking fee for a parked vehicle has been paid. It is intended for use in a parking system of the kind with which the user registers an account number and the vehicle registration number at the start of a parking period, and again registers the account number at the time of terminating the parking period of the vehicle. The account number, the vehicle registration number, the parking starting time and the parking terminating time are stored in the memory of a central computer so that billing can be effected on the account number concerned for the parking time that has elapsed between the parking commencement time and the parking terminating time. The parking control unit is portable and includes a display, a computer unit with an associated memory, and a communications unit adapted to communicate with the memory of the central computer to obtain information relating to the registration numbers of those vehicles which have commenced a parking period in the system but have not terminated the parking period of the vehicle. The parking control unit also includes an optical image or picture reproducing device which functions to reproduce an image of the registration plates of vehicles and to clearly show the registration numbers. The parking control unit is adapted to compare an imaged and clearly shown registration number with those registration numbers of vehicles that have commenced a parking period but have not terminated parking in the system, and to indicate, with the aid of an indicating means, whether or not a clearly shown registration number belongs to a vehicle that has commenced a parking period but where parking in the system has not been terminated.

BRIEF DESCRIPTION OF THE DRAWINGS

The invention will now be described in more detail with reference to exemplifying embodiments thereof and also with reference to the accompanying drawings, in which.

DESCRIPTION OF THE PREFERRED EMBODIMENTS

Figure 1:
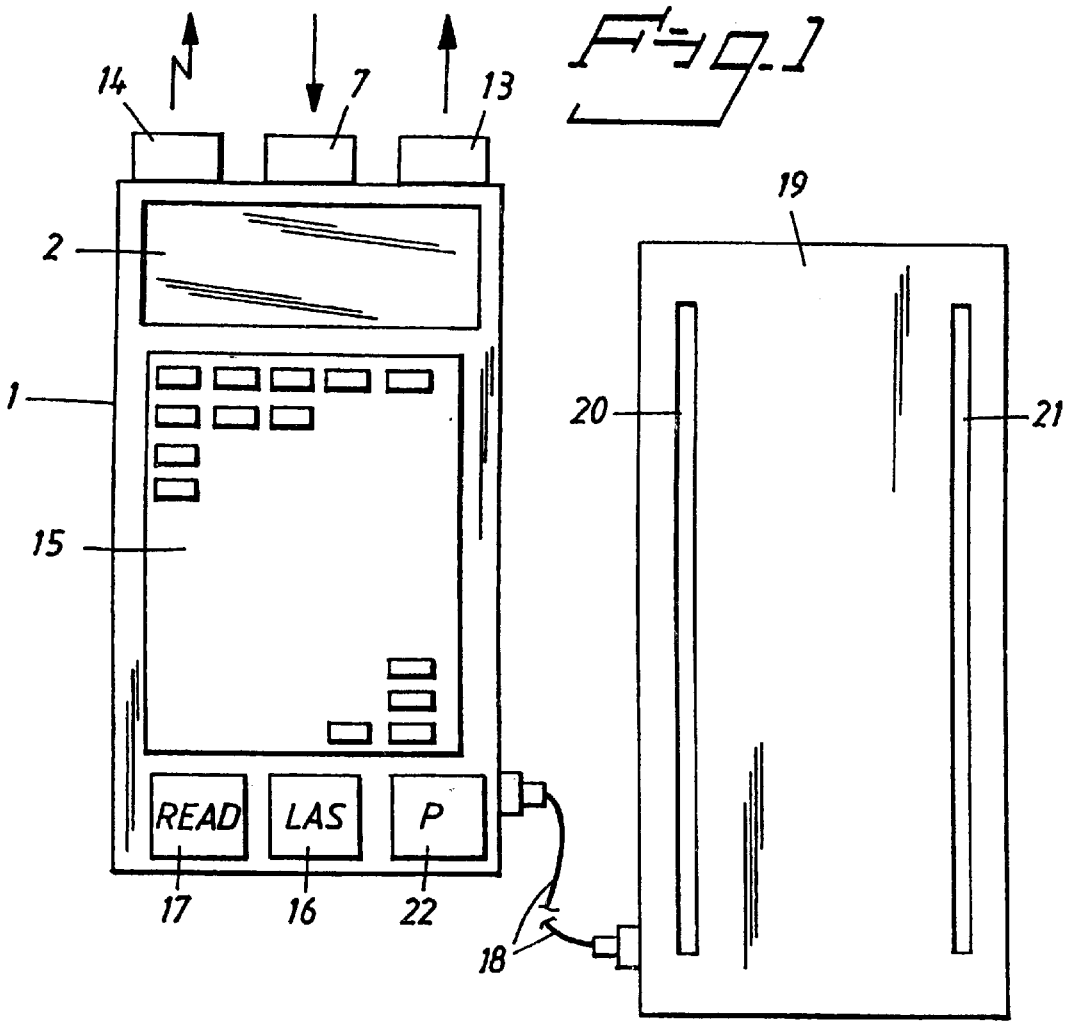
FIG. 1 illustrates a parking control unit constructed in accordance with the invention.

FIG. 1 illustrates a parking control units which is primarily intended for checking whether or not a parking fee has been paid for a parked vehicle. The parking control unit is primarily intended for use in a parking system of a kind in which the user registers an account number and the vehicle registration number at the beginning of a parking period, and again registers the account number when the parking period is terminated.

The invention can be applied to particular benefit in a parking system constructed for cash card billing by means of pay meters when the parking system includes a plurality of pay meters belonging to a pay meter system. The pay meters are equipped with a cash card reader. A person parking his/her vehicle looks for a first pay meter when initially parking the vehicle and enters the cash-card account number by passing the card through the card reader, and then enters the registration number of the vehicle to be parked through the medium of a keyboard. The account number, vehicle registration number and the time at which parking was commenced is stored in a memory. When terminating parking of the vehicle, said person looks for a second pay meter and passes the cash card through the cash card reader of this second pay meter. The second pay meter may be any pay meter included in the pay meter system. The account number of the cash card is stored in the memory of this second pay meter together with the time at which the card was read, i.e. the parking termination time. Each pay meter is connected to the memory of a central computer, so that the parking time period that has elapsed between the parking commencement time and the parking termination time can be billed to the account number concerned.

As an alternative to a cash card, any other means of payment or machine-readable identification of the person parking a vehicle can be used for billing the person concerned. In this case, devices other than generally conventional pay meters can be used to register vehicle registration numbers, to debit accounts, and to register vehicle parking commencement times and parking termination times. The main criterion in this respect is that the parking system obtains information as to the account to be debited and information relating to vehicle registration number, parking commencement time and parking termination time.

Figure 2:
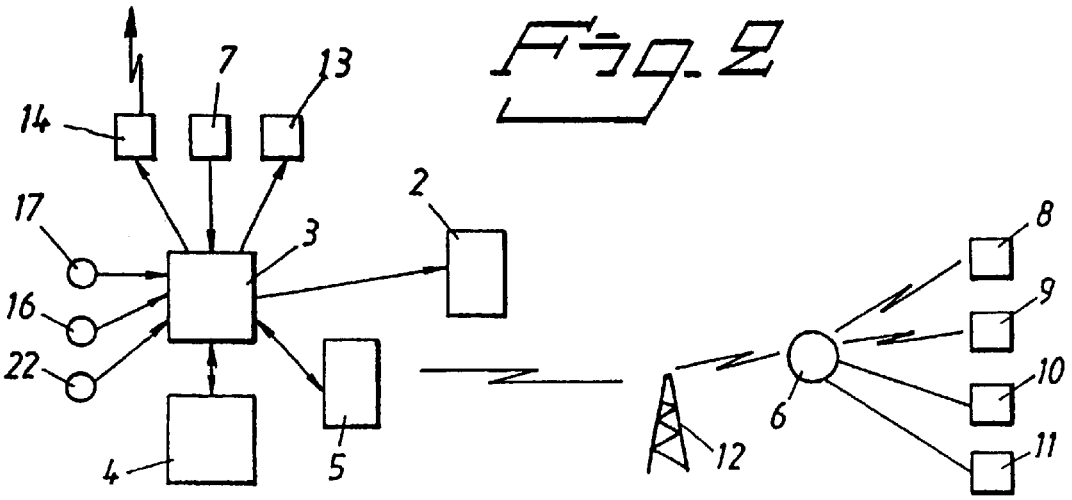
FIG. 2 is a block schematic illustrating the parking control unit shown in FIG. 1 and its communication with the surroundings.

The inventive parking control unit is portable. For instance, the parking control unit may have a size corresponding to the size of a typical portable computer terminal. Referring to FIGS. 1 and 2, parking control unit 1 includes a display 2, a computer unit 3 that includes a memory 4, and a communications unit 5 for communication with the memory of the a central computer 6 for obtaining information relating to the registration numbers of those vehicles that have commenced a parking period in the parking system but have not as yet terminated the parking period. The parking control unit 1 also includes an optical image reproducing device 7 which when aimed at a vehicle registration plate functions to reproduce and record an image of the registration plate and to clarify, that is to make clear, the vehicle registration number. The computer unit 3 of the parking control unit 1 is adapted to compare the recorded and clarified registration numbers with the registration number of those vehicles that have begun a parking period but which have not terminated the parking period in the system, these numbers being stored in the memory 4.

The communications unit 5 is adapted to communicate with the central computer 6 via radio, preferably via a mobile telephone system, as illustrated with the mast 12. However, communication can, instead, be effected via a land-based network, where information is sent to the parking control unit 1 with the aid of suitable terminals distributed at different sites in the parking system and connected to said unit. The terminals may, for instance, comprise pay meters.

FIG. 2 illustrates a number of pay meters 8–11 which deliver to the central computer 6 information relating to account number, vehicle registration number, parking commencement time and parking termination time. This transmission may be either a wireless transmission, as illustrated with the pay meters 8 and 9, or it may be effected over a permanent network, as illustrated with the pay meters 10 and 11.

Ideally, the central computer 6 will send to the parking control unit 1 solely information relating to the registration numbers of those vehicles that have commenced a parking period but have not terminated the parking period. This information thus corresponds to a list of vehicles in the parking area.

According to one preferred embodiment of the invention, the parking control unit 1 includes a low power laser 13 adapted to act as a sighting means with which a parking attendant brings the parking control unit 1 into alignment with the center part of the vehicle registration plate, whereafter the optical device 7 records an image of the registration plate.

The optical image reproducing device may be of the same kind as those used in digital cameras, i.e. include a so-called CCD element. Alternatively, a scanning laser may be used.

The optical signal received from optical device 7 is clarified by the computer 3 with respect to the registration number, which is stored in the computer memory 4. This clarification of the registration number is effected in a known manner, by processing the signal arriving from the CCD element or from the scanning laser.

According to one preferred embodiment, the parking control unit 1 is equipped with an illuminating device 14 which is adapted to illuminate the vehicle registration plates in conjunction with the optical imaging of said plates. This illuminating device may be a flood light or a camera-type flash unit. Ideally, the illuminating device is activated automatically in the case of a low light level, as in the case of modern cameras.

According to one preferred embodiment, the parking control unit 1 is equipped with a keyboard 15 by means of which a registration number can be entered manually.

The parking control unit 1 is managed by the parking attendant, who presses a button 16 to activate the laser 13 and then aims the laser beam onto the center of a vehicle registration plate. The parking attendant then presses a button 17 which activates the optical image reproducing device 7 so as to reproduce and record the registration plate. The imaged registration number is preferably presented on the display 2 so that the parking attendant is able to check that the registration plate was correctly reproduced.

According to the invention, the parking control unit is also adapted to disclose with the aid of an indicating device whether or not the registration number belongs to a vehicle that has commenced a parking period but has not terminated parking period in the system. Ideally, the indicating device will consist of said display 2 and will suitably indicate only when the registration number reproduced by the optical image reproducing device 7 is not found in the computer member 4, meaning that the vehicle is parked illegally.

As will be understood, it is necessary to update the information in the memory 4 of the parking control unit 1 continuously and at relatively short intervals. For instance, vehicle registration numbers will preferably be updated at one-minute intervals.

According to one especially preferred embodiment, the parking control unit can be connected by a cable 18 to a portable printer 19 for printing out parking fine tickets.

The printer 19 may be of any suitable kind. For Instance, it may have a first slot 20 in which a blank parking-fine ticket is inserted and then fed through the printer while being printed and then dispensed via a second slot 21. The printer is small and portable.

When the indicating device on the parking control unit 1 indicates that a vehicle is illegally parked, the parking attendant presses a button 22 so as to activate the printer and print-cut a ticket on which at least the vehicle registration number is given.

On the other hand, the parking control unit 1 may be in wireless communication via a telephone network with a motor vehicle registry that contains information relating to all vehicles in the country. The computer 3 may be programmed to collect via the communications unit information such as car model and color from the vehicle registry in respect of the vehicle whose registration plate has been read. This information can then be printed on the ticket.

According to another preferred embodiment, the optical image reproducing device 7 is adapted to enable a situation picture to be taken and stored in the memory 4 of the computer. This only requires the whole of the image received by a CCD element to be stored in the memory 4 in addition to the registration number. Such a situation image or picture may have the form of a typical photograph that shows the entire vehicle, or parts of the vehicle, and its position. These pictures or images can be transmitted from the parking control unit 1 to the memory of the central computer 6 and later used as evidence. Naturally, a picture of the vehicle registration plate can be stored as evidence, instead of a situation picture.

As an alternative to printing-out a parking-fine ticket, the registration number and, when applicable, the situation picture can be stored in the memory 4 of the parking control unit and later transferred to a printer for print-out and dispatched by mail to the owner of the vehicle. The information can also be sent to the central computer 6 for further processing directly and by means of wireless transmission.

Although the invention has been described above with reference to a number of exemplifying embodiments thereof, it will be understood that the manner in which the information is transmitted and also the manner in which the registration number is recorded can be modified.

It will therefore be understood that the invention is not restricted to said exemplifying embodiments and that modifications and variations can be made within the scope of the following Claims.

What is claimed is:

1. A portable parking control unit for enabling a parking attendant to check whether a parked vehicle within a parking system properly commenced a parking period within the system, said control unit comprising:

a. a vehicle registration plate reading device for optically reading and producing an image of a vehicle registration number carried by a vehicle registration plate, the reading device including sighting means for aligning the reading device directly with a vehicle registration plate to be read in order to accurately read the vehicle registration number carried by the registration plate, wherein the sighting means includes a low-power alignment laser that is manually aimed at the registration plate by a parking attendant to align the reading device carried by the portable parking control unit with the registration plate, and wherein the sighting means does not include an additional optical marker carried by the vehicle to be sensed to locate the vehicle registration plate;

b. a communication unit for communicating with a parking system central computer and for receiving from the central computer vehicle registration numbers for vehicles that had properly commenced a parking period by registering an account number and a vehicle registration number at the commencement of a parking period within the parking system;

c. a comparator for comparing vehicle registration numbers received from the central computer with a vehicle registration number that has been read by the reading device; and d. an indicator for providing to a parking attendant information regarding whether the registration number of a parked vehicle corresponds with a registration number of a vehicle that had properly commenced a parking period within the parking system.

2. A parking control unit according to claim 1, wherein the control unit includes an illuminating unit to illuminate a registration plate when reading said plate.

3. A parking control unit according to claim 1, wherein the control unit includes a keyboard for manually entering a vehicle registration number.

4. A parking control unit according to claim 1, wherein the vehicle registration plate reading device is a camera which enables a picture of the vehicle registration plate to be taken and stored electronically.

5. A parking control unit according to claim 4, wherein information received by the camera is displayed on said indicator.

6. A parking control unit according to claim 1, including a connector for connecting the control unit with a portable printer for printing-out a parking-fine ticket.

7. A parking control unit according to claim 1, wherein the communication unit is adapted to communicate with said central computer via radio.

8. A parking control unit according to claim 1, wherein the communication unit is adapted to communicate with said central computer over a mobile telephone system.

9. A portable parking control unit according to claim 1, wherein the control unit is contained within a unitary housing that carries the reading device, the sighting means, and an illumination source for illuminating the vehicle registration plate to enable the plate to be read by the reading means.

* * * * *